US007827976B2

(12) United States Patent
Na

(10) Patent No.: US 7,827,976 B2
(45) Date of Patent: Nov. 9, 2010

(54) TUBE UNIT OF IGNITION SPARK PLUG FOR ENGINE

(75) Inventor: Jeonghyun Na, Hwaseong (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 70 days.

(21) Appl. No.: 12/327,631

(22) Filed: Dec. 3, 2008

(65) Prior Publication Data

US 2009/0308368 A1 Dec. 17, 2009

(30) Foreign Application Priority Data

Jun. 16, 2008 (KR) ..... 10-2008-0056531

(51) Int. Cl.
*F02P 3/02* (2006.01)
*F02P 3/04* (2006.01)

(52) U.S. Cl. ..... 123/647

(58) Field of Classification Search ..... 123/647, 123/169 R, 169 PA; 313/624; 439/125, 127
See application file for complete search history.

(56) References Cited

U.S. PATENT DOCUMENTS 1,534,986 A * 4/1925 Natoli ..... 174/15.3
2,269,076 A * 1/1942 Boll ..... 313/11.5
2,616,407 A * 11/1952 Thomas ..... 313/125
2,646,782 A * 7/1953 Fisher ..... 313/120
4,114,568 A * 9/1978 Yanagihara et al. ..... 123/260
4,469,059 A * 9/1984 Hukill ..... 123/169 PA
4,901,687 A * 2/1990 Jones ..... 123/169 R
5,014,656 A * 5/1991 Leptich et al. ..... 123/169 EL

* cited by examiner

*Primary Examiner*—Mahmoud Gimie
(74) *Attorney, Agent, or Firm*—Morgan, Lewis & Bockius LLP

(57) ABSTRACT

A tube unit of a spark plug for an engine that is used for mounting the spark plug in a cylinder head, may include a spark plug tube including a hollow tube body inserted in an interior mounting hole of the cylinder head, wherein a lower end of the hollow tube body that a gasket is coupled thereto is mounted at an upper end of a penetration hole formed at a lower deck, and a compression bolt engaged to the interior mounting hole of the cylinder head at an upper end of the hollow tube body so as to apply compression force to the hollow tube body and generate surface pressure to the gasket for sealing a gap disposed between the hollow tube body and the penetration hole while the compression bolt is engaged to the interior mounting hole of the cylinder head.

20 Claims, 5 Drawing Sheets

TUBE UNIT OF IGNITION SPARK PLUG FOR ENGINE

CROSS-REFERENCE TO RELATED APPLICATION

The present application claims priority to Korean Patent Application Number 10-2008-0056531 filed Jun. 16, 2008, the entire contents of which are incorporated herein for all purposes by this reference.

BACKGROUND OF THE INVENTION

1. Field of the Invention

The present invention relates to a tube unit of a spark plug for an engine. More particularly, the present invention relates to a tube unit of a spark plug for an engine that is mounted in a cylinder head so as to mount a spark plug in the cylinder head.

2. Description of Related Art

Generally, natural gas engines or gasoline engines have an ignition device for igniting an air-fuel mixture supplied to a combustion chamber, and such an ignition device includes a spark plug that is fed high voltage from an ignition coil and generates a spark in a cylinder of an engine.

As shown in FIG. 5, a spark plug 101 is mounted at an upper portion of each cylinder head 103 in an engine by a spark plug tube 107 provided with an o-ring 105.

The spark plug tube 107 is provided with an interior mounting hole 109 for mounting the spark plug 101, and an ignition coil tube 111 is mounted at an upper portion of the cylinder head 103 by a tap 113 so as to connect the spark plug 101 to an ignition coil.

In this case, a lower portion of the spark plug tube 107 is threaded to a penetration hole 117 of a lower deck 115 that corresponds to a combustion chamber of the cylinder head 103.

For preventing the spark plug tube 107 from being coming out of the penetration hole 117 and coolant from leaking to the combustion chamber, an adhesive such as Loctite® is applied to an exterior circumference of the lower portion of the spark plug tube 107.

According to a conventional spark plug tube, the Loctite is degraded by heat and pressure created at the combustion chamber and coolant leaks into the combustion chamber. Therefore, the engine is damaged.

Since the spark plug tube expands by heat, screw thread of the spark plug tube may be broken in a case of installing or removing the spark plug, and it may come out of the penetration hole of the lower deck in a case of repairing the spark plug.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a tube unit of a spark plug for an engine having advantages of preventing a spark plug tube from coming out and coolant in a cylinder head from leaking into a combustion chamber as a consequence of a compression bolt being engaged to a cylinder head and that applies pressure on a spark plug tube after the spark plug tube is inserted in the cylinder head, and a gasket is interposed between the spark plug tube and the cylinder head.

In an aspect of the present invention, a tube unit of a spark plug for an engine that is used for mounting the spark plug in a cylinder head, may include a spark plug tube including a hollow tube body inserted in an interior mounting hole of the cylinder head, wherein a lower end of the hollow tube body that a gasket is coupled thereto is mounted at an upper end of a penetration hole formed at a lower deck, and/or a compression bolt engaged to the interior mounting hole of the cylinder head at an upper end of the hollow tube body so as to apply compression force to the hollow tube body and generate surface pressure to the gasket for sealing a gap disposed between the hollow tube body and the penetration hole while the compression bolt is engaged to the interior mounting hole of the cylinder head.

The hollow tube body may be shaped of reversed truncated cone.

The hollow tube body may be shaped of cylinder.

The penetration hole formed at the lower deck may be provided with a screw thread formed at an interior circumference thereof such that the spark plug is selectively engaged thereto.

The hollow tube body may include an inner slanted surface formed along inner circumference thereof and inclined downwards with a predetermined angle to guide the spark plug to the penetration hole.

The hollow tube body at exterior circumference thereof may include an o-ring mounting hole for mounting an o-ring. The o-ring mounting hole may be formed at an upper portion of the hollow tube body.

The hollow tube body may include a stepped surface formed along exterior circumference at the lower end of the hollow tube body and abutting the upper end of the penetration hole, wherein the gasket is disposed between the stepped surface and the upper end of the penetration hole while the compression bolt is engaged to the interior mounting hole of the cylinder head.

The hollow tube body may include a mounting groove along the exterior circumference in the lower end thereof under the stepped surface to receive inner circumference of the gasket therein.

An exterior diameter of the stepped surface may be smaller than that of the hollow tube body.

At least an outer slanted surface may be formed along exterior circumference at a lower portion of the hollow tube body, configured to correspond to the lower deck, and disposed apart from each other by a predetermined distance in a longitudinal direction of the spark plug tube.

The outer slanted surfaces may be inclined downwards by a predetermined angle, and an exterior diameter of the outer slanted surface disposed in upper direction is larger than that of the outer slanted surface disposed in lower direction.

The lower end of the hollow tube body may be elastic sufficiently enough to be expanded by the compression bolt while the compression bolt is engaged to the interior mounting hole of the cylinder head in a state in which the gasket is inserted therein so as to prevent the gasket from releasing therefrom.

The compression bolt may be hollow-shaped and inner diameter of the compression bolt is smaller than outer diameter of the upper end of the hollow tube body.

An upper portion of the compression bolt may have a coupling portion in order that the compression bolt can be engaged to or disengaged from the interior mounting hole by an engaging tool.

A screw thread may be formed along exterior circumference at upper end of the compression bolt such that the compression bolt is threaded to the interior mounting hole of the cylinder head.

The gasket may have an annular shape so as to be inserted in the lower end of the hollow tube body.

The gasket may be made of copper material.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
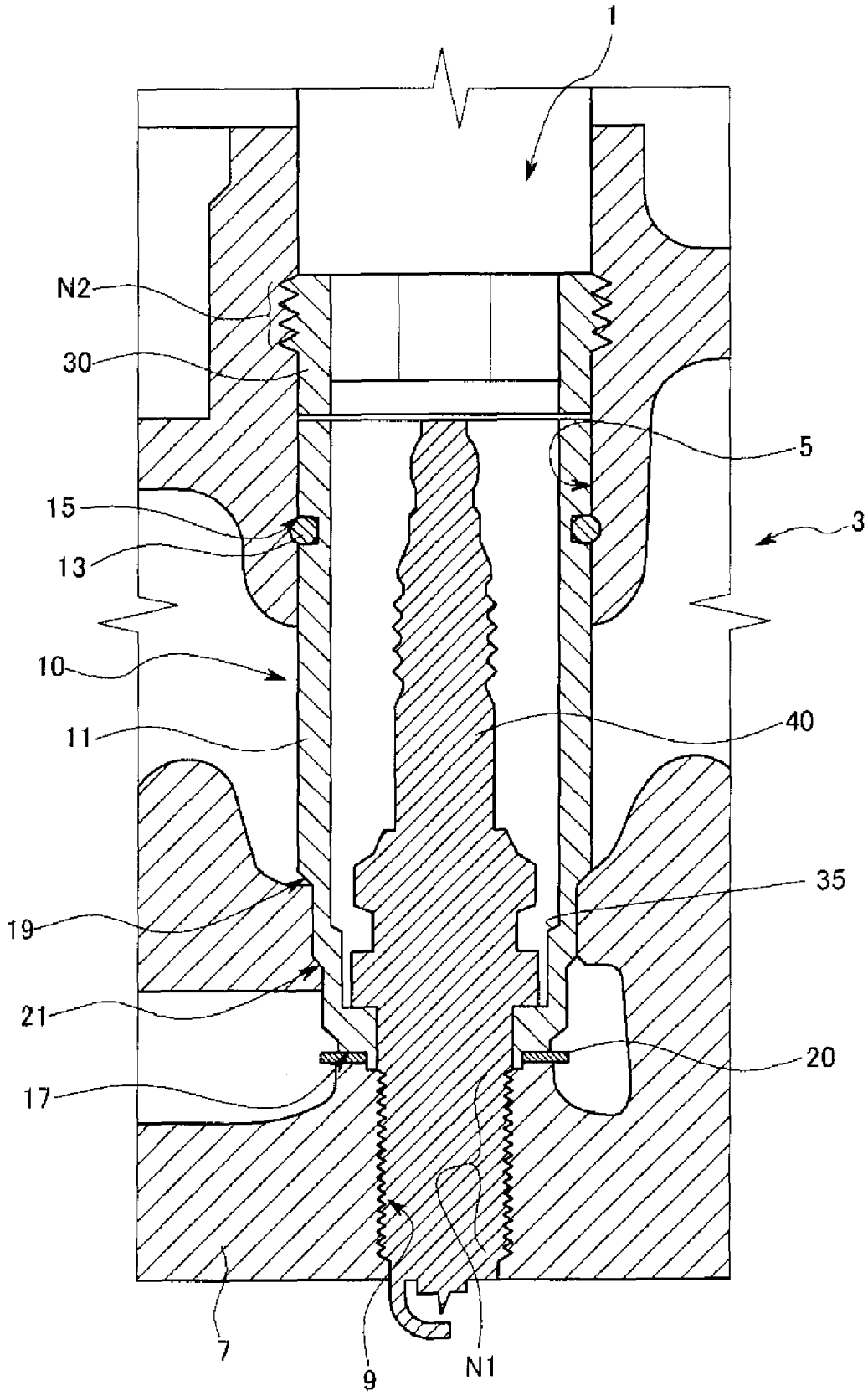
FIG. 1 is a cross-sectional view of a cylinder head in which an exemplary tube unit of a spark plug for an engine according to the present invention is mounted.
Figure 2:
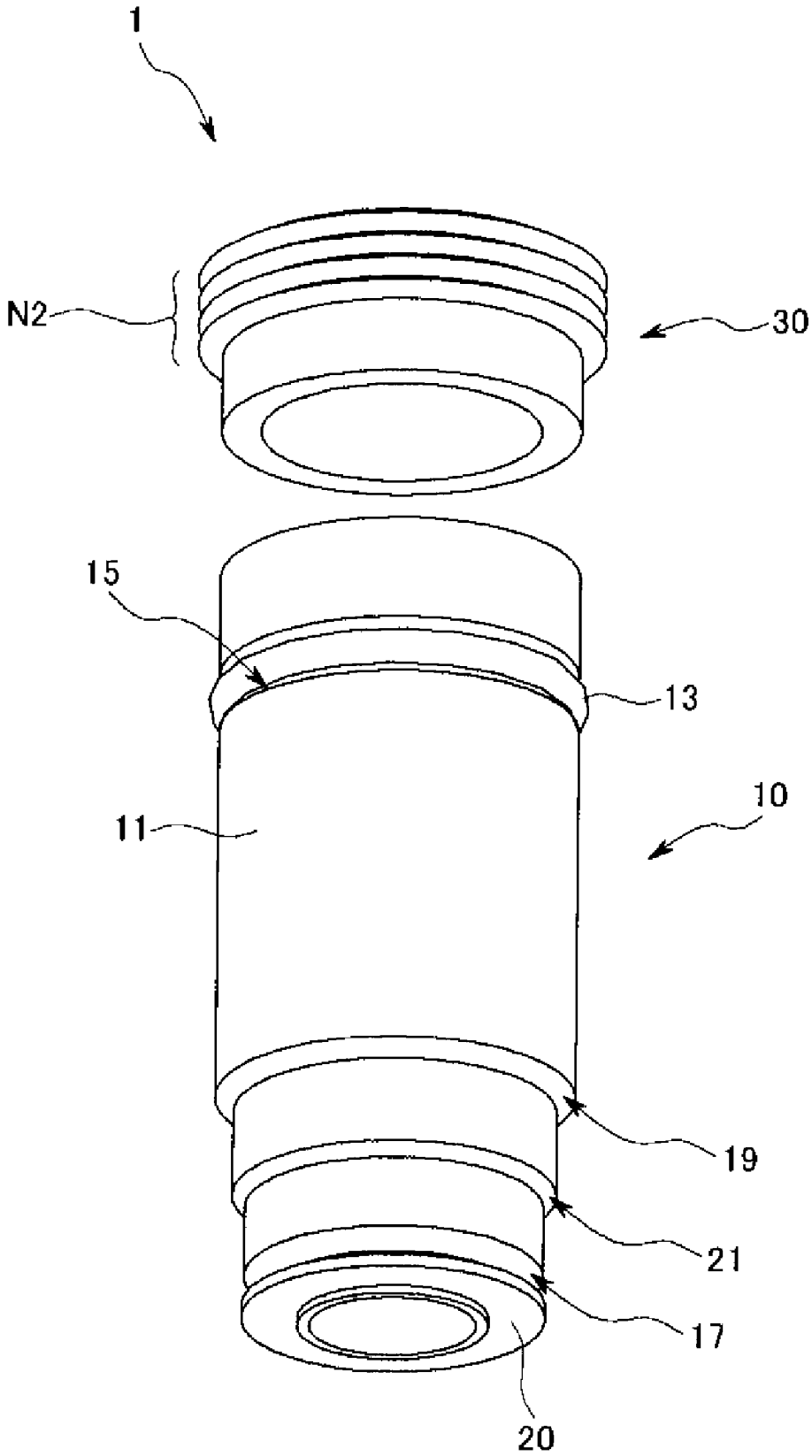
FIG. 2 is a perspective view showing a tube unit of an exemplary spark plug for an engine according to the present invention.
Figure 3:
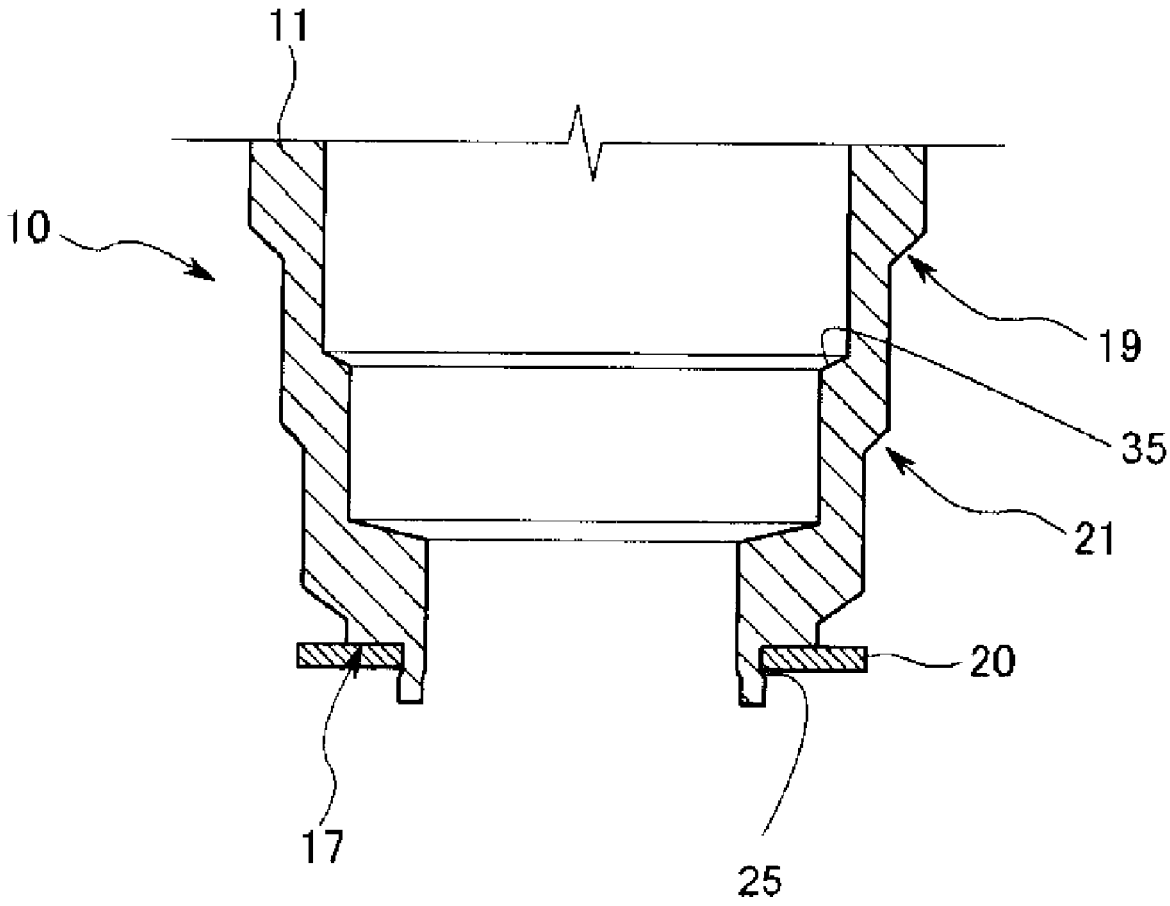
FIG. 3 is a partial cross-sectional view of an exemplary spark plug tube according to the present invention.
Figure 4:
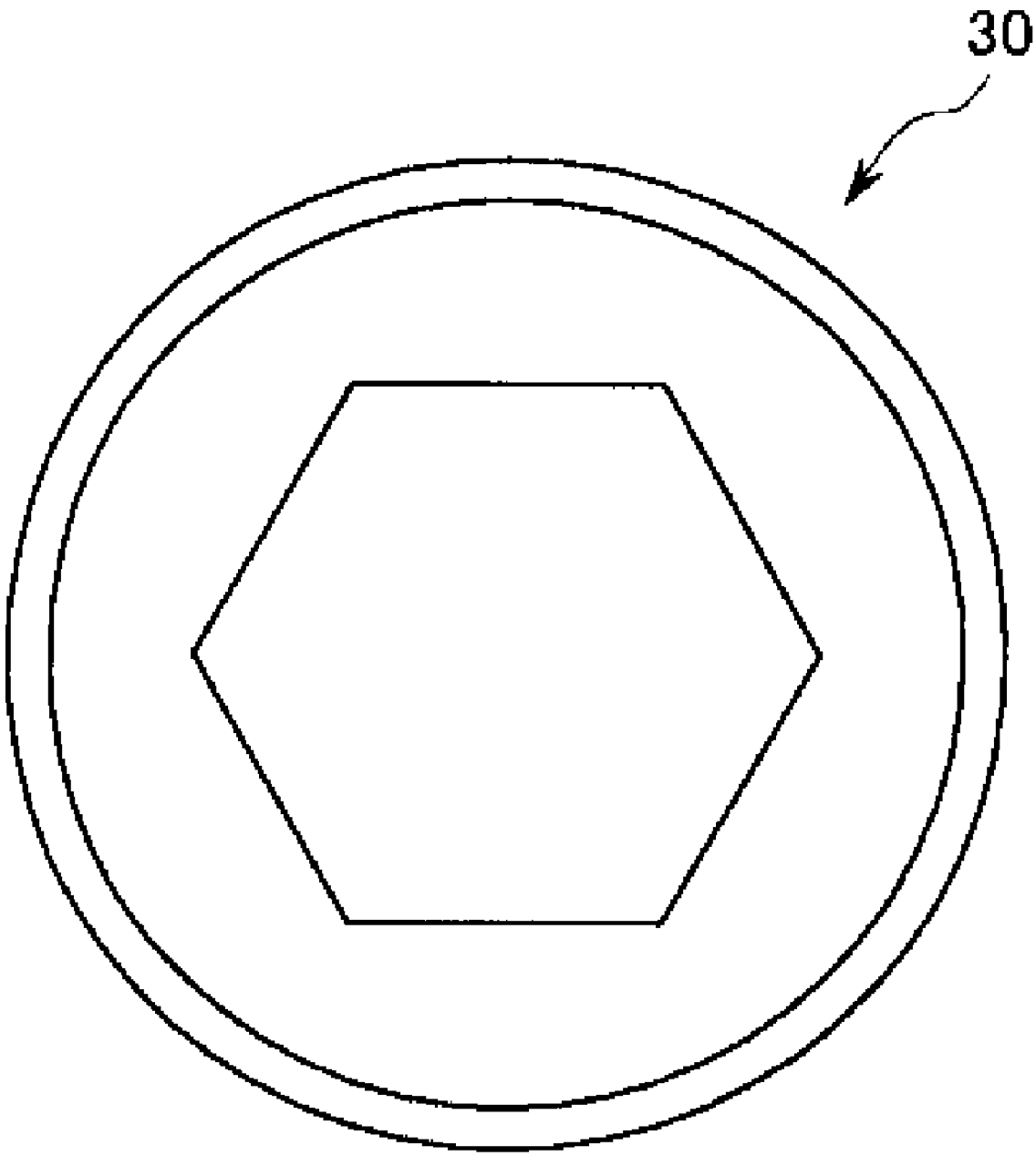
FIG. 4 is a top plan view of an exemplary compression bolt according to the present invention.
Figure 5:
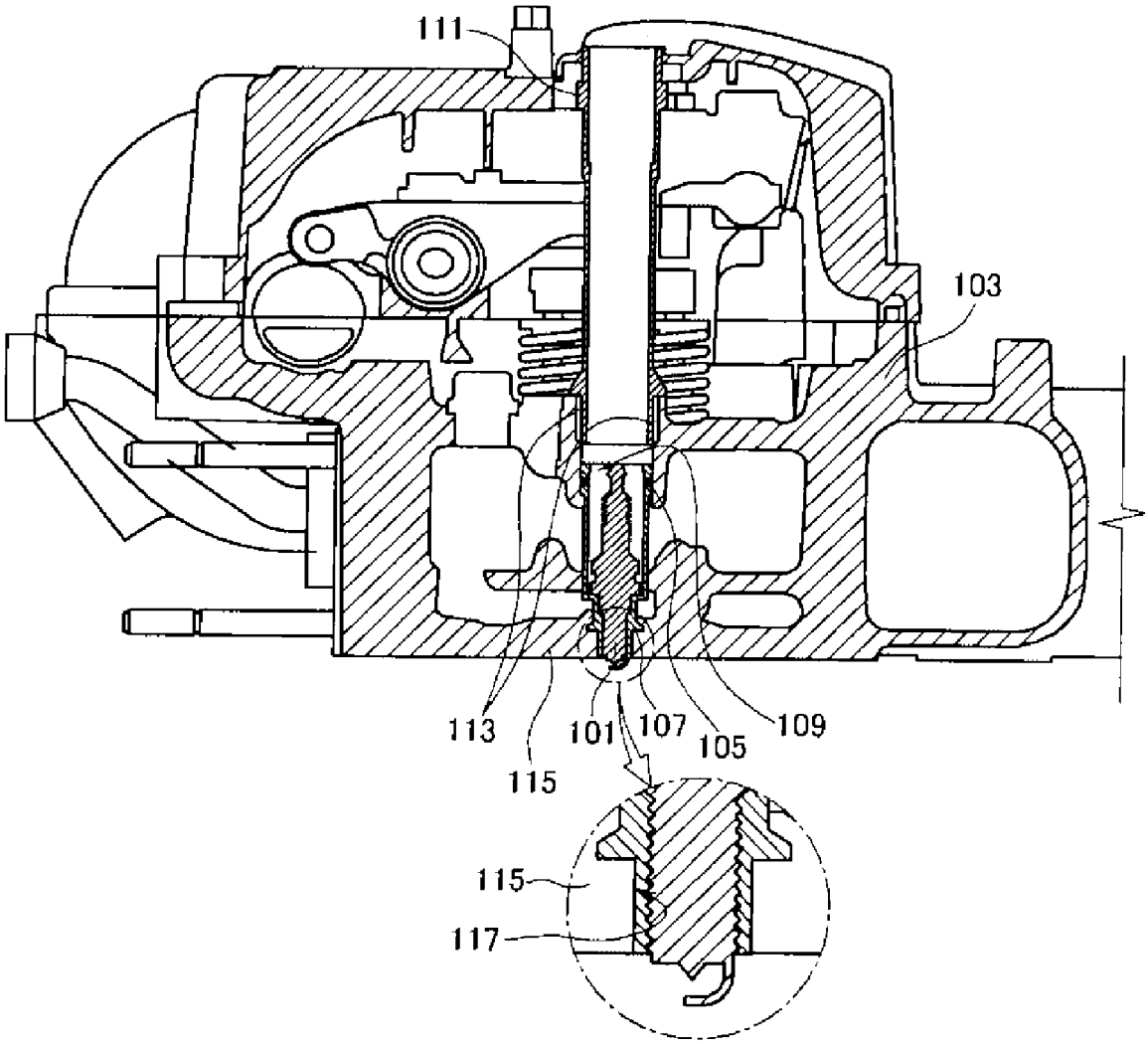
FIG. 5 is a partially cut-away perspective view of a cylinder head in which a conventional spark plug tube is mounted.

FIG. 1 is a cross-sectional view of a cylinder head in which a tube unit of a spark plug for an engine according to various embodiments of the present invention is mounted, FIG. 2 is a perspective view showing a tube unit of a spark plug for an engine according to various embodiments of the present invention, FIG. 3 is a partial cross-sectional view of a spark plug tube according to various embodiments of the present invention, and FIG. 4 is a top plan view of a compression bolt according to various embodiments of the present invention.

Referring to the drawings, a tube unit 1 of a spark plug for an engine according to various embodiments of the present invention is used for mounting a spark plug 40 in a cylinder head 3, and includes a spark plug tube 10 having a gasket 20 and a compression bolt 30. The compression bolt 30 is disposed at an upper portion of the spark plug tube 10 in a state in which the spark plug tube 10 is inserted in the cylinder head 3 so as to apply pressure to the spark plug tube 10. Therefore, the spark plug tube 10 and the spark plug 40 are prevented from coming apart when repairing the spark plug 50, and coolant in the cylinder head 3 is prevented from leaking into a combustion chamber by the gasket 20.

For these purposes, the tube unit 1 of a spark plug, as shown in FIG. 1 and FIG. 2, includes the spark plug tube 10 and the compression bolt 30.

The spark plug tube 10 is inserted in an interior mounting hole 5 of the cylinder head 3, and a lower end of the spark plug tube 10 is sealed at an upper end of a penetration hole 9 of a lower deck 7 through the gasket 20.

A screw thread N1 is formed at an interior circumference of the penetration hole 9 such that the spark plug 40 is engaged to the penetration hole 9.

Such a spark plug tube 10 includes a hollow cylindrical tube body 11.

An o-ring mounting hole 15 for mounting an o-ring 13 is formed along an exterior circumference at an upper portion of the tube body 11.

A stepped surface 17 is formed at the lower end of the tube body 11 and abuts the upper end of the penetration hole 9. In addition, the gasket 20 is fixed between the stepped surface 17 and the penetration hole 9 in a state of being inserted in the lower end of the tube body 11.

Here, the stepped surface 17 is formed along the exterior circumference of the tube body 1, and an exterior diameter of the stepped surface 17 is smaller than that of the tube body 11 so that pressure of the compression bolt 30 can be concentrated to the stepped surface 17 and sealing efficiency of the gasket 20 is increased.

In various embodiments of the present invention, the tube body 11 may be a shape of a reversed truncated cone so that pressure of the compression bolt 30 can be further concentrated to the stepped surface 17.

The gasket 20 has an annular shape so as to be inserted in the lower end of the tube body 1, and is made of copper materials.

In addition, the lower end of the tube body 11, as shown in FIG. 3, is expanded by the compression pressure of the compression bolt 30 in a state in which the gasket 20 is inserted therein so as to prevent the gasket 20 from coming away therefrom.

Furthermore, a mounting groove 25 is formed at lower end of the tube body 11 to receive the gasket 20 therein so that the gasket 20 can be further strongly coupled to the tube body 11.

First and second slanted surfaces 19 and 21 are formed at a lower portion of the tube body 11 corresponding to the lower deck 7, and are disposed apart from each other by a predetermined distance.

Here, the first and second slanted surfaces 19 and 21 are slanted to the exterior circumference of the tube body 11 by a predetermined angle so that the compression force of the compression bolt 30 can be guided to lower portion of the center axis of the tube body 11 so that the compression pressure of the compression bolt 30 can be further concentrated to the stepped surface 17 and sealing efficiency of the gasket 20 is increased.

In addition, the exterior diameter of the first slanted surface 19 is larger than that of the second slanted surface 21.

Meanwhile, the compression bolt 30 has a cylindrical shape, and is engaged to the interior mounting hole 5 of the cylinder head 3 at an upper end of the spark plug tube 10 so as to apply compression force to the spark plug tube 10 and generate surface pressure for sealing at the gasket 20.

A screw thread N2 is formed at an upper exterior circumference of the compression bolt 30 such that the compression bolt 30 is threaded to the interior mounting hole 5 of the cylinder head 3.

In addition, an upper interior circumference of the compression bolt 30, as shown in FIG. 4, has a hexagonal shape so as to coincide with a shape of an engaging tool.

The upper portion of the compression bolt 30 may be dented as shown in FIG. 1 or hollow as shown in FIG. 2.

Hereinafter, installation and operation of the tube unit 1 of a spark plug according to various embodiments of the present invention will be described in detail.

At first, in a state in which the gasket 20 is inserted in the lower end of the tube body 11, the tube body 11 is inserted into the interior mounting hole 5 of the cylinder head 3.

After the spark plug tube 10 is inserted in the interior mounting hole 5 of the cylinder head 3, the compression bolt 30 is threaded to the interior mounting hole 5 on the upper end of the spark plug tube 10 such that the lower end of the tube body 11 is expanded by the compression force supplied from the compression bolt 30.

In this configuration, the gasket 20 does not come away from the tube body 11 (referring to FIG. 3) and furthermore, the gasket 20 is pressed by the compression bolt 30 between the lower deck 7 and the tube body 11 so that sealing efficiency of the gasket 20 is increased. As a result, the coolant is prevented from leaking through the penetration hole 9 of the lower deck 7 and the spark plug tube 10 is firmly fixed to the interior mounting hole 5.

In this case, the compression bolt 30 applies the compression force to the spark plug tube 10 and generates the surface pressure at the gasket 20 interposed between the penetration hole 9 and the stepped surface 17 of the spark plug tube 10.

As a consequence of generation of the surface pressure at the gasket 20 by the compression force of the compression bolt 30, the coolant is prevented from leaking through the penetration hole 9.

In addition, the o-ring 13 seals the interior mounting hole 5 and the spark plug tube 10 so as to prevent the coolant from leaking through the interior mounting hole 5 of the cylinder head 3 and the spark plug tube 10.

The number of the o-ring may not be limited to one but can be increased according to the sealing efficiency and cost.

Meanwhile, when the spark plug tube 10 is inserted in the interior mounting hole 5, the stepped surface 17 and the first and second slanted surfaces 19 and 21 abut the lower deck 7 and the penetration hole 9. Therefore, the spark plug tube 10 is fixed to a predetermined position in the cylinder head 3.

Therefore, if the tube unit 1 of a spark plug according to various embodiments of the present invention is applied to the engine, the compression bolt 30 is threaded to the interior mounting hole 5 on the spark plug tube 10 in a state in which the spark plug tube 10 provided with the gasket 20 at the lower end thereof is inserted in the interior mounting hole 5 of the cylinder head 3. Therefore, the spark plug tube 10 and the spark plug 40 are prevented from coming out of the penetration hole 9 of the lower deck 7 when repairing the spark plug.

In addition, since the surface pressure is generated at the gasket 20 interposed between the penetration hole 9 of the lower deck 7 and the spark plug tube 10 as a consequence of the compression bolt 30 applying the compression force to the spark plug tube 10, the coolant is prevented from leaking and thereby the engine is prevented from breaking down.

In various embodiments of the present invention, the inner circumference of the tube body 11 may include at least an inner slanted surface 35 configured to be slanted inwards with a predetermined angle so that the spark plug 40 can be easily positioned to the penetration hole 9 as the user assembles the spark plug 40 into the spark plug tube 10.

According to various aspects of the present invention, the compression bolt is threaded to the interior mounting hole on the spark plug tube in a state in which the spark plug tube provided with the gasket at the lower end thereof is inserted in the interior mounting hole of the cylinder head. Therefore, the spark plug tube and the spark plug are prevented from coming out of the penetration hole of the lower deck when repairing the spark plug.

Since the surface pressure is generated at the gasket interposed between the penetration hole of the lower deck and the spark plug tube as a consequence of the compression bolt applying the compression force to the spark plug tube, the coolant is prevented from leaking and thereby the engine is prevented from breaking down.

For convenience in explanation and accurate definition in the appended claims, the terms "upper", "lower", "interior", and "exterior" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A tube unit of a spark plug for an engine that is used for mounting the spark plug in a cylinder head, comprising:

a spark plug tube including a hollow tube body inserted in an interior mounting hole of the cylinder head, the hollow tube including a sealed lower end having a gasket for sealing against an upper end of a penetration hole formed at a lower deck, wherein the spark plug is slidably received in the spark plug tube and a lower end portion of the spark plug protrudes from the sealed lower end and engaged to the penetration hole; and a compression bolt engaging the interior mounting hole of the cylinder head at an upper end of the hollow tube body so as to apply compression force to the hollow tube body and generate surface pressure against the gasket to seal a gap disposed between the hollow tube body and the penetration hole while the compression bolt is engaged to the interior mounting hole of the cylinder head.

2. The tube unit of a spark plug of claim 1, wherein the hollow tube body has a reversed-truncated-cone shape.

3. The tube unit of a spark plug of claim 1, wherein the hollow tube body is cylindrical.

4. The tube unit of a spark plug of claim 1, wherein the penetration hole formed at the lower deck is provided with a thread formed at an interior circumference thereof such that the spark plug is selectively engaged thereto.

5. The tube unit of a spark plug of claim 1, wherein the hollow tube body includes an inner slanted surface formed along inner circumference thereof and inclined downwards with a predetermined angle to guide the spark plug to the penetration hole.

6. The tube unit of a spark plug of claim 1, wherein the hollow tube body at exterior circumference thereof includes an o-ring mounting hole for mounting an o-ring.

7. The tube unit of a spark plug of claim 6, wherein the o-ring mounting hole is formed at an upper portion of the hollow tube body.

8. The tube unit of a spark plug of claim 1, wherein the hollow tube body includes a stepped surface formed along exterior circumference at the lower end of the hollow tube body and abutting the upper end of the penetration hole, wherein the gasket is disposed between the stepped surface and the upper end of the penetration hole while the compression bolt is engaged to the interior mounting hole of the cylinder head.

9. The tube unit of a spark plug of claim 8, wherein the hollow tube body comprises a mounting groove along the exterior circumference in the lower end thereof under the stepped surface to receive inner circumference of the gasket therein.

10. The tube unit of a spark plug of claim 8, wherein an exterior diameter of the stepped surface is smaller than that of the hollow tube body.

11. The tube unit of a spark plug of claim 1, wherein at least an outer slanted surface are formed along exterior circumference at a lower portion of the hollow tube body, configured to correspond to the lower deck, and disposed apart from each other by a predetermined distance in a longitudinal direction of the spark plug tube.

12. The tube unit of a spark plug of claim 11, wherein the outer slanted surfaces are inclined downwards by a predetermined angle, and an exterior diameter of the outer slanted surface disposed in upper direction is larger than that of the outer slanted surface disposed in lower direction.

13. The tube unit of a spark plug of claim 1, wherein the lower end of the hollow tube body is elastic sufficiently enough to be expanded by the compression bolt while the compression bolt is engaged to the interior mounting hole of the cylinder head in a state in which the gasket is inserted therein so as to prevent the gasket from releasing therefrom.

14. The tube unit of a spark plug of claim 1, wherein the compression bolt is hollow-shaped and inner diameter of the compression bolt is smaller than outer diameter of the upper end of the hollow tube body.

15. The tube unit of a spark plug of claim 1, wherein an upper portion of the compression bolt has a coupling portion in order that the compression bolt can be engaged to or disengaged from the interior mounting hole by an engaging tool.

16. The tube unit of a spark plug of claim 1, wherein a screw thread is formed along exterior circumference at upper end of the compression bolt such that the compression bolt is threaded to the interior mounting hole of the cylinder head.

17. The tube unit of a spark plug of claim 1, wherein the gasket has an annular shape so as to be inserted in the lower end of the hollow tube body.

18. The tube unit of a spark plug of claim 1, wherein the gasket is made of copper material.

19. An engine comprising the tube unit of a spark plug of claim 1 mounted in a cylinder head.

20. A passenger vehicle comprising the engine claim 19.

* * * * *